US005103579A

United States Patent [19]

Mayers

[11] Patent Number: 5,103,579

[45] Date of Patent: Apr. 14, 1992

[54] NOVELTY JEWELRY PIN

[75] Inventor: Benjamin H. Mayers, Mercer Island, Wash.

[73] Assignee: Ace Novelty Co., Inc., Bellevue, Wash.

[21] Appl. No.: 513,541

[22] Filed: Apr. 14, 1990

[51] Int. Cl.[5] ..... A44C 3/00

[52] U.S. Cl. ..... 40/1.5

[58] Field of Search ..... 40/152, 152.1, 124.4, 40/124, 1.5; 63/20

[56] References Cited

U.S. PATENT DOCUMENTS

| | | | |
|---|---|---|---|
| 23,042 | 2/1859 | Oliver | 63/20 X |
| 569,039 | 10/1896 | Eads | 40/1.5 |
| 766,913 | 8/1904 | Stone | 40/1.6 X |
| 1,658,573 | 2/1928 | Roper et al. | 40/1.5 |
| 1,755,222 | 4/1930 | Minnick | 40/158.1 |
| 3,605,438 | 9/1971 | Chalson | 63/12 X |
| 3,879,874 | 4/1975 | Broussard, Sr. | 40/160 X |
| 4,161,831 | 7/1979 | Restle | 40/160 |
| 4,530,863 | 7/1985 | Seeger | 40/160 X |

OTHER PUBLICATIONS

Fotofolks International Ltd., Fotofolks Photo Statues, Copyright 1986.

*Primary Examiner*—Kenneth J. Dorner
*Assistant Examiner*—Milton Nelson, Jr.
*Attorney, Agent, or Firm*—Jones, Day, Reavis & Pogue

[57] ABSTRACT

A novelty pin that has a photograph of a prominent individual such as sports figure directly printed on a metal plate in the shape of a silhouette of at least the head and upper body portion of the person. The photograph silhouette is slightly smaller than the metal plate body portion silhouette thereby enabling the metal body portion silhouette to outline the photograph silhouette. A coat of clear epoxy is placed over the printed photograph for protection thereof and a fastener is attached to the back of the pin to enable the pin to be attached to an object such as clothing.

6 Claims, 1 Drawing Sheet

NOVELTY JEWELRY PIN

FIELD OF THE INVENTION

The present invention relates to novelty pins in general and in particular to a metal novelty pin that has a silhouette of a head and upper body portion of a person. A photograph of at least the head and upper body portion of a prominent person substantially identical to the metal body portion silhouette is printed directly on the body portion silhouette. A clear coating of epoxy is placed over the photograph to protect it and a fastener is attached to the back of the pin for attaching the pin to an object such as clothing.

BACKGROUND OF THE INVENTION

Novelty jewelry is well-known in the art and includes pins of all types having fasteners on the back side thereof that can be attached to an object such as clothing. The pins relate to animals, vegetables, and mineral objects.

It is well-known today that, in particular, sports individuals from basketball, baseball, football, tennis, hockey, etc. have attracted great followings in the public and the public expresses a great deal of honor and esteem for such individuals. Consequently, there have been a number of products on the market relating to sports individuals such as game cards, wherein the picture of the individual is printed on a card with statistics or other information relating to the player also printed on the card. Cards usually include the player's team, his position, uniform number, and other information.

The present invention provides an additional way of honoring such individuals by providing a metal novelty pin comprising a silhouette of a body portion of such individual, usually the front of a head and upper body portion, a photograph of at least the head and upper body portion of a prominent person such as a sports individual printed directly on the metal and having a silhouette substantially identical to the metal body portion silhouette. The photograph is printed directly on the body portion of the silhouette and a coat of clear epoxy is placed over the photograph for protection. A fastener is attached to the back of the pin for attaching the pin to an object such as clothing. The photograph can include the name of the person, the team for which he plays, or other such information. If the player silhouette in the photograph is slightly smaller than the metal body portion silhouette, the metal body portion silhouette will outline the photographic silhouette. If the body portion silhouette is made of metal from the group comprising brass, aluminum, steel or copper, and is polished to a high luster, it will outline the silhouette of the photograph in a striking manner. Of course, the body portion may be made of other materials, but the preferred composition is metal from the group indicated.

SUMMARY OF THE INVENTION

Thus the present invention relates to a novelty pin comprising a metal plate in the form of a silhouette of substantially the head and upper body portion of a person, a photograph of at least the head and upper body portion of a prominent person, said photograph having a silhouette substantially identical to the metal body portion silhouette and being printed directly on the metal body portion silhouette, a coat of clear epoxy placed over the photograph for protection, and a fastener attached to the back of the pin for attaching the pin to an object.

The invention also relates to a method of forming a novelty pin comprising the step of forming a metal silhouette of a body portion of a person, preparing a photograph of at least the head and upper body portion of a prominent person, said photograph having a silhouette substantially identical to the body portion silhouette, printing the photograph directly on the metal body portion silhouette in a superimposed relationship, placing a clear coat of epoxy over the photograph for protecting the photograph, and attaching a fastener to the back of the pin for attaching the pin to another object such as clothing.

BRIEF DESCRIPTION OF THE DRAWINGS

These and other objects of the present invention will be more easily and readily understood by one skilled in the art by reference to the following detailed description taken in conjunction with the accompanying drawings which like numerals represent like elements and in which.

DETAILED DESCRIPTION OF THE DRAWINGS

Figure 1:
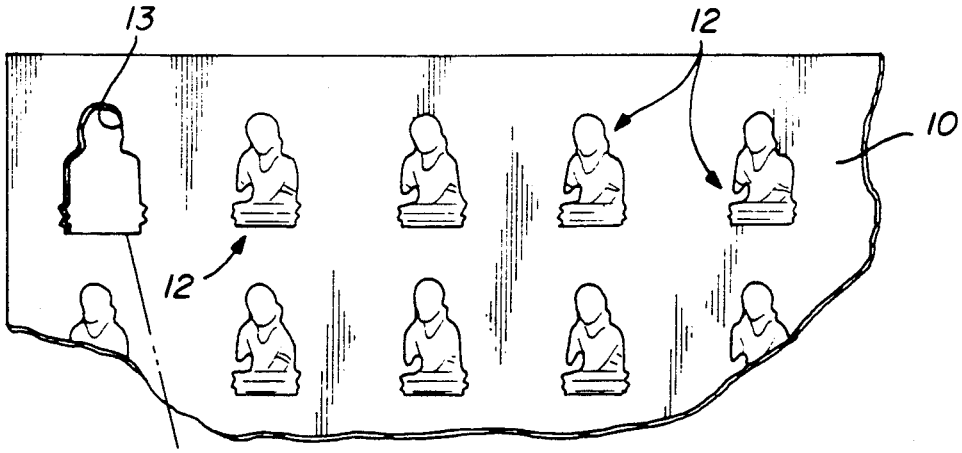
FIG. 1 is a plan view of a metal plate having multiple photographs of a person printed directly on the metal plate.

The novel pins are constructed by printing a photograph or photographs of a person or persons that are to be honored directly on a polished metal plate. Thus, as can be seen in FIG. 1, the metal plate 10, which may be formed of the group of metals comprising brass, copper, steel, or aluminum, has a plurality of photographs 12 printed directly on the metal plate 10. The photographs 12 may be in color or black and white, and may be of the same person or different individuals. The process of printing a photograph directly on a metal plate is old and well-known in the art and will not be described here.

Figure 2:
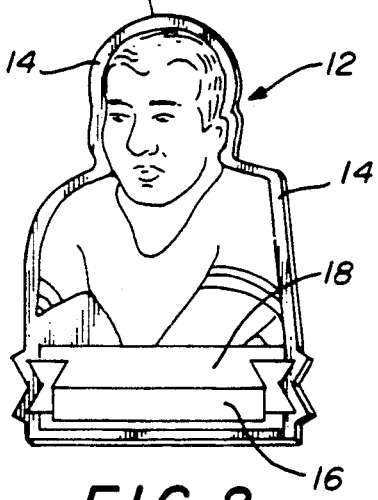
FIG. 2 an enlarged version or one of the novel photographs after it has been removed such as, for instance, by die cutting from the metal plate as illustrated in FIG. 1.

The individual photographs 12 are then die cut from the plate 10 as illustrated by the space 13 in FIG. 1 to obtain the individual metal pins with the photographs thereon as illustrated in FIG. 2. It will be noted in FIG. 2 that the photograph silhouette 12 is slightly smaller than the die cut metal plate 10 on which the photograph is printed, thereby enabling the metal body portion silhouette 10 to outline the photograph silhouette 12 with a border 14, thus creating a pleasing aesthetic appearance that is striking to the eye because of the border 14. Because the border 14 is formed with the metal 10 and that metal may be of the group comprising brass, copper, aluminum, and steel, that metal, in the form of the sheet 10, is polished to a high luster and that luster of the border 14 surrounding the photograph 12 gives the striking appearance. The pin 12 in FIG. 2 also includes a logo forming part of the photograph with the logo including the name 16 of the individual in the photograph and the name of the team 18 for which that person plays or is associated.

Figure 4:
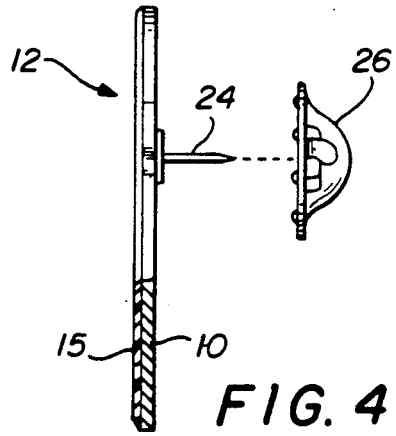
FIG. 4 is a partial side view of one of the novelty pins of FIG. 2 illustrating a tack that has been attached to the back side for receiving a clutch pin such that the pin can be attached to clothing or other objects.
Figure 3:
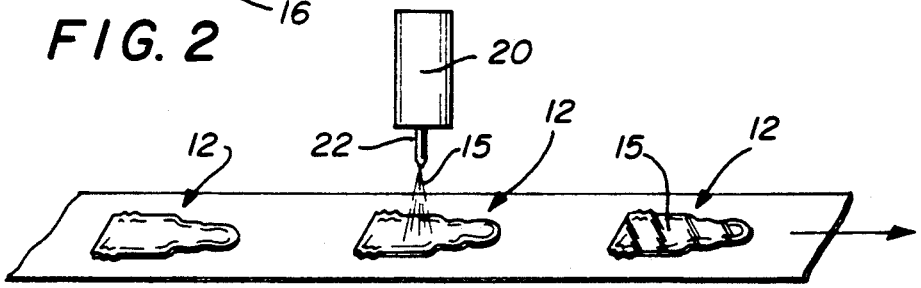
FIG. 3 represents the application of a clear epoxy to each of the navel pins illustrated in FIG. 2.

In order to protect the photograph 12 that has been printed directly on the metal 10, the pin is then covered with a clear epoxy. This is illustrated in FIG. 3 where the individual pins with photograph 12 pass under a machine 20 having a nozzle 22 that sprays the epoxy 15 directly on each pin. When the epoxy 15 has hardened, a tack 24 is applied to the back of the pin 12 by soldering or other well-known means as indicated in FIG. 4. A clutch-pin 26 may then be placed over the tack in the usual manner to attach the pin to clothing or other objects.

Figure 5:
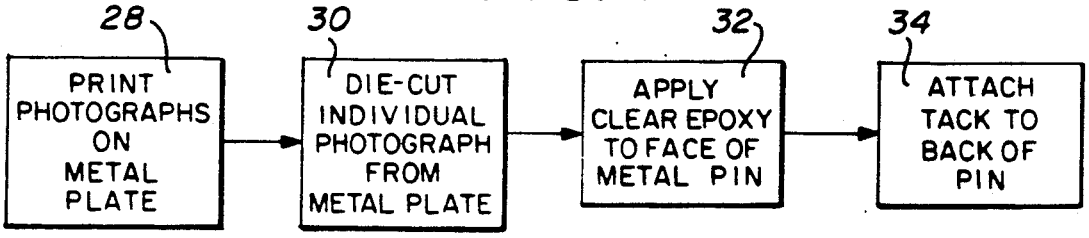
FIG. 5 is a flow chart illustrating the novel steps of forming the unique novelty pins of the present invention.

FIG. 5 is a flow chart illustrating the process of the present invention. At the step 28, the photograph 12 of the person to be honored is printed directly on a metal plate 10 that has been polished to a high gloss or luster. At step 30, the individual photograph 12 is die cut from the plate 10 in such a manner that the silhouette of the metal 10 forming the pin is slightly larger than the silhouette of the photograph 12 thereby enabling the metal 10 body portion to outline the photograph 12 silhouette with a border 14. This border 14 creates a striking and pleasant appearance to the eye.

In step 32, the clear epoxy is applied to each pin and in step 34, a tack is attached to the back side of the pin for receiving a clutch 26 to hold the pin attached to a garment or other object.

Thus, there has been disclosed a novelty pin that is striking in appearance and that can be attached to clothing and which has thereon a photograph of an individual to be honored, in particular sports figures or other notable persons. The photograph is printed directly onto the metal base and may have as a part thereof a logo including the name of the person and the organization of which he is a part. The silhouette of the metal base is substantially identical to the photograph silhouette but slightly larger, thereby enabling the metal body portion silhouette to outline the photograph silhouette, thereby creating a striking appearance. A clear epoxy is applied over the entire pin to protect the pin and maintain it in a clean condition. A tack may be attached to the back side of the pin so that the pin can be worn on a garment or placed on another object.

For ease of description, the novel pin has been disclosed with respect to a person. However, it will be understood by those skilled in the art that animals, plants or other items could also be the subject of the pins.

While the invention has been shown and described with respect to a particular embodiment thereof, this is for the purpose of illustration rather than limitation; and other variations and modifications of the specific embodiment herein shown and described will be apparent to those skilled in the art and are within the intended spirit and scope of the invention. Accordingly, the patent is not to be limited in scope and effect to the specific embodiment shown and described nor in any other way that is inconsistent with the extent to which the progress in the art has been advanced by the invention.

What is claimed is:

1. A novelty pin comprising:

a metal plate in the shape of a silhouette of at least a body portion of a person;

a photograph of a person directly printed on the metal plate silhouette, said photograph having a silhouette substantially identical to the metal plate silhouette, said photograph silhouette being slightly smaller than said metal plate body portion silhouette to form a border, thereby enabling the metal body portion silhouette to outline the photograph silhouette to create a striking visual effect;

a coat of clear epoxy placed over the printed photograph for protection thereof; and a fastener attached to a back portion of the pin for attaching the pin to an object.

2. A pin as in claim 1 wherein said photograph is in color.

3. A pin as in claim 1 wherein said metal body portion silhouette is polished to a high luster.

4. A pin as in claim 1 wherein said metal is from the group consisting of brass, steel, aluminum, and copper.

5. A pin as in claim 1 wherein said photograph is of a sports individual.

6. A pin as in claim 5 further comprising a logo attached to and forming part of said photograph, said logo including the sports individual name and team name.

* * * * *

UNITED STATES PATENT AND TRADEMARK OFFICE

CERTIFICATE OF CORRECTION

PATENT NO. : 5,103,579

DATED : April 14, 1992

INVENTOR(S) : Benjamin H. Mayers

It is certified that error appears in the above-identified patent and that said Letters Patent is hereby corrected as shown below:

On title page, item [22], "Apr. 14, 1990" should read --Apr. 24, 1990--.

Signed and Sealed this

Twenty-second Day of June, 1993

*Attest:*

Michael K. Kirk

MICHAEL K. KIRK

*Attesting Officer*

*Acting Commissioner of Patents and Trademarks*